US006402085B1

(12) United States Patent
Smith

(10) Patent No.: US 6,402,085 B1
(45) Date of Patent: Jun. 11, 2002

(54) LOCK TIGHT ROLLED PAPER DISPENSER

(76) Inventor: Tony A. Smith, Rte. 1, Box 456C, Walnut Springs, TX (US) 76690

( * ) Notice: Subject to any disclaimer, the term of this patent is extended or adjusted under 35 U.S.C. 154(b) by 0 days.

(21) Appl. No.: 09/920,116

(22) Filed: Aug. 2, 2001

(51) Int. Cl.[7] ..... B65H 75/24

(52) U.S. Cl. ..... 242/578; 242/598.3; 242/599; 242/599.3

(58) Field of Search ..... 242/578, 578.2, 242/598, 598.1, 598.3, 598.4, 599, 599.1, 599.2, 599.3, 596, 596.4, 596.7, 596.8, 592

(56) References Cited

U.S. PATENT DOCUMENTS

| | | | | | |
|---|---|---|---|---|---|
| 925,105 | A | | 6/1909 | Kaufman | |
| 1,811,779 | A | * | 6/1931 | Caps | 242/578 |
| 2,144,757 | A | * | 1/1939 | Gilling et al. | 242/596.7 |
| 2,889,122 | A | | 6/1959 | McConnell | |
| 3,038,676 | A | | 6/1962 | Mayer | |
| 3,140,059 | A | | 7/1964 | Lusebrink | |
| 3,833,180 | A | * | 9/1974 | Balasic | 242/598.3 |
| 4,097,002 | A | * | 6/1978 | Krueger | 242/596.8 |
| 4,105,168 | A | | 8/1978 | Rutherford | |
| 5,292,083 | A | | 3/1994 | Ridenour | |
| 5,878,976 | A | | 3/1999 | Duck | |
| 6,079,603 | A | | 6/2000 | Smengal | |

* cited by examiner

*Primary Examiner*—William A. Rivera
(74) *Attorney, Agent, or Firm*—Randal D. Homburg

(57) ABSTRACT

An adjustable width rolled paper dispenser having a central adjustable locking rod captured between a pair of adjustable side brackets contained in the mounting base, the side brackets having locking channels to capture and secure the slotted ends of the adjustable locking rod, preventing the displacement of the adjustable locking rod from the side brackets when dispensing a segment of the rolled paper.

2 Claims, 2 Drawing Sheets

LOCK TIGHT ROLLED PAPER DISPENSER

CROSS REFERENCE TO RELATED APPLICATIONS

None

I. BACKGROUND OF THE INVENTION

1. Field of Invention

The invention is an adjustable width rolled paper dispenser having a central adjustable locking rod captured between a pair of adjustable side brackets contained in the mounting base, the side brackets having locking channels to capture and secure the slotted ends of the adjustable locking rod, preventing the displacement of the adjustable locking rod from the side brackets when dispensing a segment of the rolled paper.

2. Description of Prior Art

The following United States patents were discovered and are disclosed within this application for utility patent. All relate to paper towel dispensers. A first prior art patent, U.S. Pat. No. 6,079,603 to Smegal, discloses a paper towel dispenser incorporated into a cabinet, wherein the cabinet has a slot for the rolled paper to emerge, the paper towels mounted on a dispenser within the cabinet.

Four spring-loaded roller rods are disclosed in U.S. Pat. No. 925,105 to Kaufman, U.S. Pat. No. 2,889,122 to McConnell, U.S. Pat. No. 3,140,059 to Lusebrink and U.S. Pat. No. 5,292,083 to Ridenour, all of them having two components bias apart by a spring, the rolled paper placed on the roller rod and the rod placed between two fixed brackets.

Rolled paper dispenser brackets are disclosed in three U.S. Pat. No. 3,038,676 to Mayer, U.S. Pat. No. 4,105,168 to Rutherford, and U.S. Pat. No. 5,878,976 to Duck. The Mayer patent is a simple bracket having two pivotally mounted side brackets engaging a mounting base. The Rutherford patent includes a spring means to draw the two side brackets into each other with a spring tension. The Duck patent involves a first spring included to draw the side brackets together and a second spring to tension the side brackets towards the mounting base. Duck also discloses an adjustable threaded retaining ring to provide a third adjusting tension to tighten the rolled paper firmly within the side brackets.

II. SUMMARY OF THE INVENTION

The primary objective of the invention is to provide a rolled paper dispenser which securely attaches the rolled paper to the dispenser preventing accidental displacement of the rolled towel from the dispenser during the dispensing process. A second objective of the invention is to provide an adjustable dispenser to accommodate rolled paper products of variable size.

III. DESCRIPTION OF THE DRAWINGS

The following drawings are submitted with this utility patent application.

IV. DESCRIPTION OF THE PREFERRED EMBODIMENT

Figure 1:
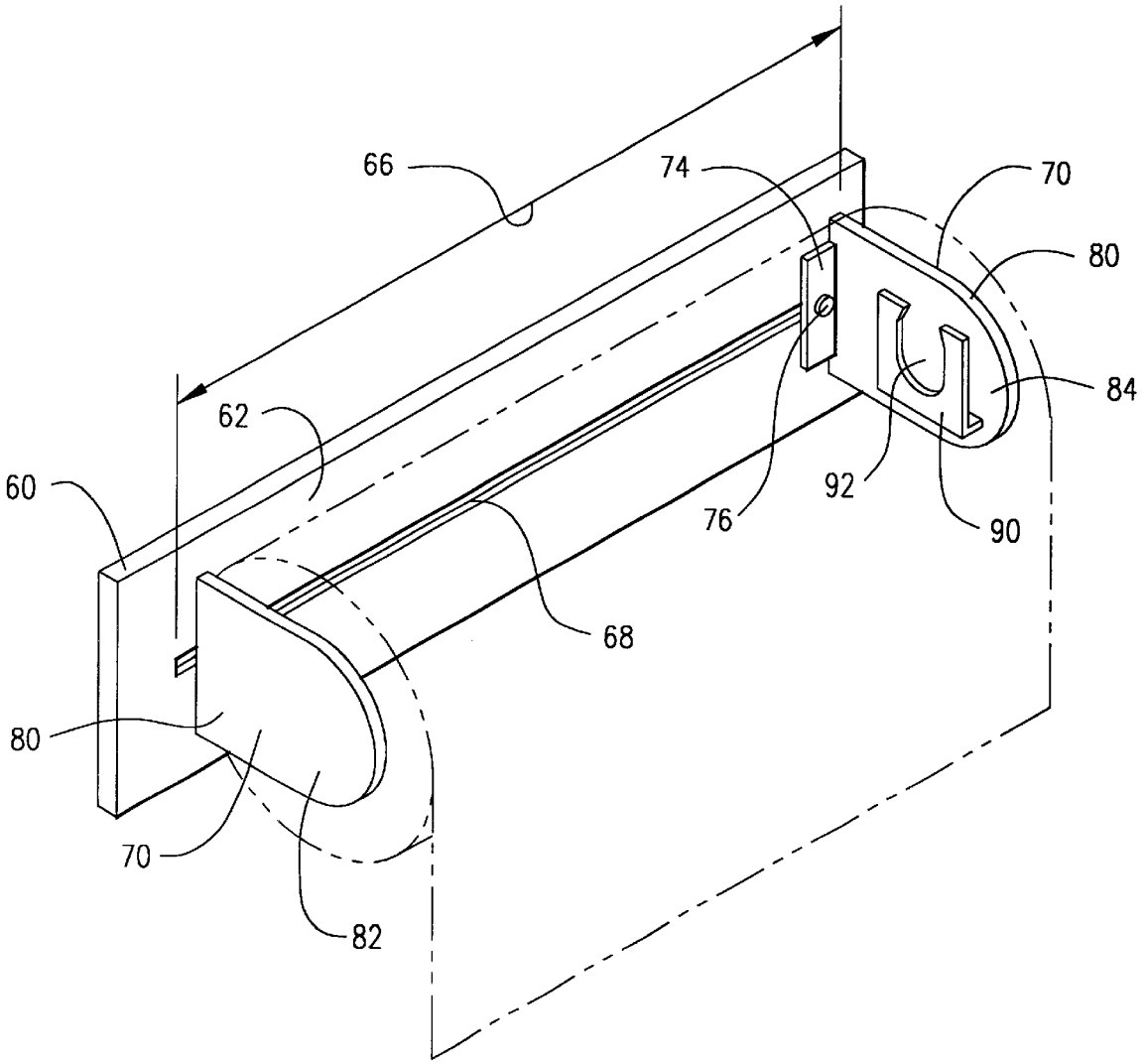
FIG. 1 is a perspective view of the invention.

The invention, as shown in FIGS. 1–4 of the drawings, is an adjustable width secure rolled paper dispenser for stable holding of rolled paper products, the invention comprising an adjustable locking rod 20 captured between a pair of adjustable side brackets 70 slidably and lockingly engaged within a mounting base 60, the adjustable side brackets 70 having locking channel clips 90 to capture and secure a first slotted end 32 and a second slotted end 42 of the adjustable locking rod 20, preventing the unintentional displacement of the adjustable locking rod 20 from the adjustable side brackets 70 when dispensing the rolled paper products. The adjustable locking rod 20 is inserted through a hollow tube of the rolled paper product prior to attachment of the adjustable locking rod 20 to the adjustable side brackets 70, holding the rolled paper product within the device for dispensing and containment.

Figure 4:
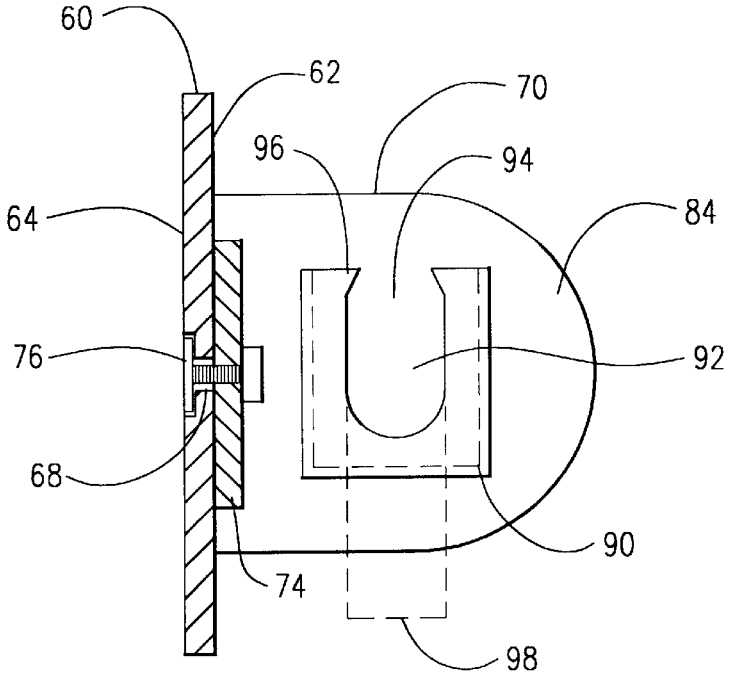
FIG. 4 is an end view of a side bracket, including the rod mounting flange engaged within the mounting base.

The mounting base 60, as shown in FIGS. 1 and 4 of the drawings, is relatively flat, having a front surface 62, a rear surface 64, a length 66 and a longitudinal slot 66 within a portion of the length 66, the longitudinal slot 68 open from the front surface 62 to the rear surface 64. The rear surface 64 is placed against any flat surface and the mounting base 60 is thus attached with the front surface 62 facing away from the flat surface.

Figure 2:
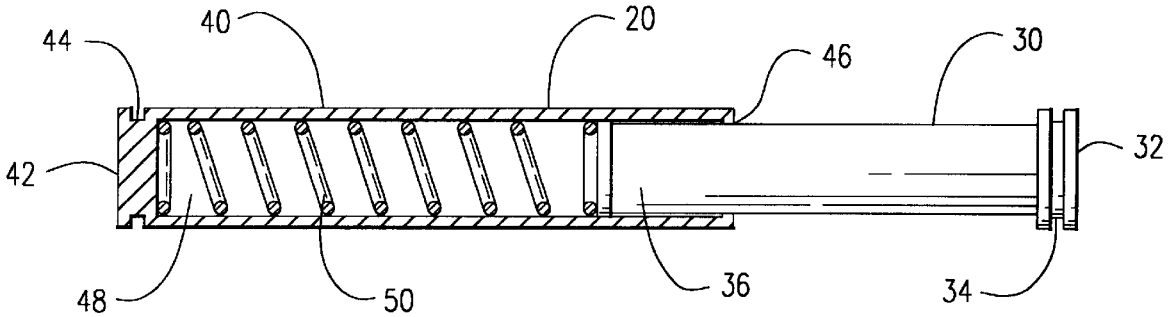
FIG. 2 is a side, cross-sectional view of a side bracket with the rod mounting flange engaging the adjustable locking rod.
Figure 3:
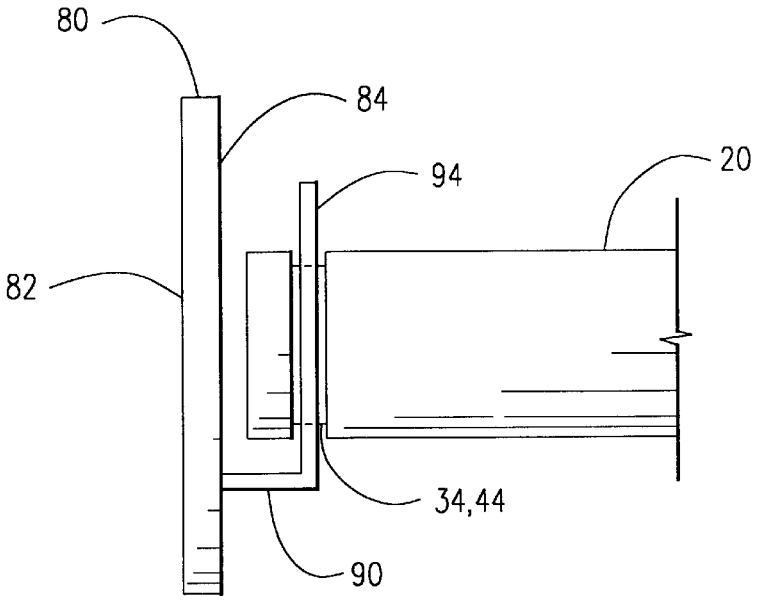
FIG. 3 is a cross-sectional view of the adjustable locking rod.

The adjustable locking rod 20, as shown in FIGS. 2 and 3 of the drawings, is cylindrical and has a first rod 30 having the first slotted end 32 and an insertion end 36, a second rod 40 having a second slotted end 42 and a receiving end 46, the receiving end 46 accepting the insertion end 36 in a slidable engagement. The second rod 40 has an inner hollow portion 48 having a base end 49, corresponding to the second slotted end 42, the inner hollow portion 48 containing a spring coil 50. The spring coil 50 rests against the base end 49 pushing against the insertion end 36 of the first rod 30, acting to force the first rod 30 away from the second rod 40. The first slotted end 32 and the second slotted end 42 both include respective recessed grooves 34, 44 which engage the locking channel clips 90 in the adjustable side brackets 70, as shown in FIG. 2 of the drawings.

Each of the pair of adjustable side brackets 70, as shown in FIGS. 1, 2 and 4 of the drawings, includes a locking base flange 74 having a locking means 76 to lock the base flange 74 in a determined location within the longitudinal slot 68 on the front surface 62 of the mounting base 60, such determined location depending on the width of the rolled paper product. Each adjustable side bracket 70 also includes a side flange 80, having an outer surface 82 and a inner surface 84, the locking channel clip 90 located on the inner surface 84, wherein the side flanges 80 are positioned with the inner surfaces 84 facing each other when secured within the mounting base 60. As shown in FIGS. 2 and 4 of the drawings, the locking channel clips 90 extend from the inner surface 84 and include a vertically oriented rod channel 92 having an upper end 94 within which are located a pair of locking fingers 96. The rod channel 92 has a width 98 allowing the recessed grooves 34, 44 on the first slotted end 32 and the second slotted end 42 of the adjustable locking rod 20 to fit within the rod channel 92, but narrow enough not to allow any other portion of the adjustable locking rod 20 to enter such rod channel 92. The locking fingers 96 are resilient and allow forcible passage of the recessed grooves 34, 44 into and out of the rod channels 92, thus requiring some direct and applied force to engage and disengage the adjustable locking rod 20 from the rod channel 92.

While the invention has been particularly shown and described with reference to a preferred embodiment thereof, it will be understood by those skilled in the art that changes in form and detail may be made therein without departing from the spirit and scope of the invention.

What is claimed is:

1. An adjustable width secure rolled paper dispenser for stable holding of a rolled paper product, the invention comprising:

a. an adjustable locking rod having a first slotted end and a second slotted end;

b. a pair of adjustable side brackets having locking channel clips to capture and secure the first slotted end and the second slotted end of the adjustable locking rod; and c. a mounting base within which the adjustable side brackets are slidably and lockingly engaged, wherein the adjustable locking rod is inserted through a hollow tube of the rolled paper product prior to attachment of the adjustable locking rod to the adjustable side brackets, holding the rolled paper product in such manner as to prevent the unintentional displacement of the adjustable locking rod from the adjustable side brackets when dispensing a sheet of paper from the rolled paper product.

2. The device, as disclosed in claim 1, further comprising:

a. the mounting base is relatively flat, having a front surface, a rear surface, a length and a longitudinal slot within a portion of the length, the longitudinal slot open from the front surface to the rear surface installing the rear surface against a flat surface and with the front surface facing away from such flat surface;

b. the adjustable locking rod is cylindrical and has a first rod having the first slotted end and an insertion end, a second rod having the second slotted end and a receiving end, the receiving end accepting the insertion end in a slidable engagement, such second rod having an inner hollow portion having a base end, corresponding to the second slotted end, the inner hollow portion containing a spring coil which rests against the base end pushing against the insertion end of the first rod, acting to force the first rod away from the second rod c. the first slotted end and the second slotted end include respective recessed grooves which engaging the locking channel clips in the adjustable side brackets;

d. each of the pair of adjustable side brackets includes a locking base flange having a locking means to lock the base flange within the longitudinal slot on the front surface of the mounting base, each adjustable side bracket also includes a side flange, having an outer surface and a inner surface, the locking channel clip located on the inner surface, wherein the side flanges are positioned with the inner surfaces facing each other when secured within the mounting base; and e. the locking channel clips include a vertically oriented rod channel having an upper end within which are located a pair of locking fingers, the rod channel having a width allowing the recessed grooves on the first slotted end and the second slotted end of the adjustable locking rod to fit within the rod channel, but such width not so much as to allow any other portion of the adjustable locking rod to enter such rod channel, such locking fingers resilient allowing a forcible passage of the recessed grooves into and out of the rod channels thus requiring a direct and applied force to engage and disengage the adjustable locking rod from the rod channel.

* * * * *